US008919020B2

(12) United States Patent
Polovnev et al.

(10) Patent No.: US 8,919,020 B2
(45) Date of Patent: Dec. 30, 2014

(54) DEVICE FOR UNDERWATER FIRING FROM A FIREARM

(76) Inventors: Andrey Albertovich Polovnev, Moscow (RU); Liliyana Borisovna Polovneva, Moscow (RU)

( * ) Notice: Subject to any disclaimer, the term of this patent is extended or adjusted under 35 U.S.C. 154(b) by 0 days.

(21) Appl. No.: 14/005,984

(22) PCT Filed: Mar. 6, 2012

(86) PCT No.: PCT/RU2012/000162

§ 371 (c)(1),
(2), (4) Date: Sep. 18, 2013

(87) PCT Pub. No.: WO2012/128666

PCT Pub. Date: Sep. 27, 2012

(65) Prior Publication Data

US 2014/0013639 A1 Jan. 16, 2014

(30) Foreign Application Priority Data

Mar. 21, 2011 (RU) ..... 2011110330

(51) Int. Cl.
*F41C 9/06* (2006.01)

(52) U.S. Cl.
CPC ..... *F41C 9/06* (2013.01)
USPC ..... 42/1.14

(58) Field of Classification Search
CPC ..... F41C 9/06; F41C 9/00; A01K 81/00; F42B 30/14
USPC ..... 42/96, 90, 106, 1.14; 206/317; 224/243; 89/5, 30, 31, 1.809; 114/316
See application file for complete search history.

(56) References Cited

U.S. PATENT DOCUMENTS 5,639,982 A 6/1997 Cipolla
5,966,858 A 10/1999 Curtis et al.

(Continued)

FOREIGN PATENT DOCUMENTS

EP 2053342 A1 4/2009
EP 2224200 A1 9/2010
EP 1884736 B1 5/2013
NO 2007 6207 12/2007
NO 2008 4978 11/2008

(Continued)

OTHER PUBLICATIONS

WIPO, International Patent No. PCT/RU2012/000162; International Search Report, dated Oct. 18, 2012.

*Primary Examiner* — Samir Abdosh
*Assistant Examiner* — John D Cooper
(74) *Attorney, Agent, or Firm* — John B. Hardaway, III; Nexsen Pruet, LLC

(57) ABSTRACT

This invention generally relates to firearms or more precisely—to devices providing underwater firing firearms from within the dry environment.

The device for underwater firing for a firearm comprises: a weapon with ammunition, a fire control tool and a controllable muzzle valve with a passage opening intended for passing of the projectile in the course of the underwater shot.

Moreover, the device comprises an outer housing having inside it at least a weapon and ammunition.

The fire control tool has at least one pyrotechnical charge intended to produce inside the housing before firing the excessive pressure exceeding the exterior water pressure.

Moreover, the fire control tool is connected with the muzzle valve that provides firing after opening of the muzzle valve in the result of increasing pressure of the pyrotechnical gas inside the housing and ceasing firing after closing of the muzzle valve.

The muzzle valve is installed in such a way that it can bypass the pyrotechnical gas from the housing into the water through its passage opening.

This invention increases the efficiency of firing under the water and reliability of the device for underwater firing from a firearm.

11 Claims, 2 Drawing Sheets

(56) References Cited

U.S. PATENT DOCUMENTS

| | | | | |
|---|---|---|---|---|
| 7,237,353 | B1 | 7/2007 | Beauchamp et al. | |
| 7,681,352 | B2 | 3/2010 | Fu et al. | |
| 7,942,420 | B2 | 5/2011 | Polovnev et al. | |
| 8,082,851 | B2 | 12/2011 | Polovnev et al. | |
| 8,464,625 | B2 | 6/2013 | Polovnev et al. | |
| 2010/0281730 | A1* | 11/2010 | Fu et al. | 42/1.14 |

FOREIGN PATENT DOCUMENTS

| | | | |
|---|---|---|---|
| RU | 2176772 | C2 | 12/2001 |
| RU | 2268455 | C1 | 1/2006 |
| RU | 2321811 | C2 | 4/2008 |
| RU | 2316712 | C2 | 10/2008 |
| RU | 2316718 | C1 | 10/2008 |
| RU | 2355967 | C1 | 5/2009 |

* cited by examiner

DEVICE FOR UNDERWATER FIRING FROM A FIREARM

TECHNICAL FIELD

The invention relates to firearm or more precisely—to devices providing underwater firing of firearm from within the dry environment.

PRIOR ART

The need to create such a device for underwater firing from a firearm is stipulated by the fact that ammunition with a cavitating core (underwater projectile or bullet) intended for firing in the water and from the air into the water are known in the art (see Description to Patents RU 2268455 C1, Int. Cl.[7] F42B 10/38 of 20 Jan. 2006 and RU 2316718 C1, Int. Cl.[7] F42B 12/74 of 10 Feb. 2008; U.S. Pat. No. 8,082,851 B2, Int. Cl.[7] F42B 10/38 of 27 Dec. 2011; European Patent Application 07747813.9 of 12, Feb. 2007, publication No. EP 2053342 A1 of 29 Apr. 2009; and Norwegian Patent Application No. 20084978 of 27 Nov. 2008).

It is possible to fire ammunition with an underwater projectile (bullet) from the air into the water using any weapon. But the weapon barrel is to be dry, because penetration of water into the barrel and formation of a water blockage results in swelling and rupture of the barrel.

Underwater firing is accompanied by ejection of water out of the barrel, but the barrel is to be completely filled with water before firing because formation of a water or air blockage results in swelling and rupture of the barrel. In the course of firing standard weapon caliber 5.45-9 mm with the fire rate of 600 rounds/min under the water, the barrel is completely filled with water between the shots. Such a short time of filling the barrel with water (less than 0.1 sec) is caused by the fact that a cartridge extracted from the barrel and ammunition chambered into the barrel force water into the barrel operating as pistons of the pump. That is why many types of standard weapon are successfully used for firing in the water with caliber and sub-caliber projectiles having sabots, which discard in the water. For firing in the water underwater ammunition with a special charge are used. This charge provides maximal allowable pressure in the barrel and muzzle pressure of the propellant gas. Higher muzzle pressure of the gas increases the shock wave formed when the projectile enters the water, and this wave increases hydraulic pressure in front of the muzzle end of the barrel where the underwater projectile cannot form a cavitation cavity and is slowed down by a viscous flow of water. Because of the limited allowable pressure of the propellant gas, the muzzle velocity of the underwater ammunition projectile fired under the water is by 15-20% lower than the muzzle velocity of the same projectile but loaded into the ammunition intended for firing from the air and into the water.

But not every firearm is appropriate for firing in the water. For example, a shot from 12 or 20 gauge smooth bore shotguns ejects water with the mass that is 4 to 5 times higher than the mass of standard shot/bullet projectiles used in these shotguns for firing in the air.

In the course of firing from these shotguns in the water the underwater projectile velocity is 2.2-2.5 times lower than during firing from these shotguns in the air. That is why in the "Aqua shooting range" these shotguns are used only for firing from the air and into the water for "underwater hunting" and sports shooting purposes (see Description to Patent RU 2316712 C2, Int. Cl.[7] F41J 1/18 of 10 Oct. 2008; European Patent Specification No. EP 1884736 B1 of 29, May 2013; U.S. Pat. No. 7,942,420 B2, Int. Cl.[7] F41J11/00 of 17 May 2011; Norwegian Patent Application 20076207 of 3 Dec. 2007).

Devices for underwater firing, which provide reliable firing from within the dry weapon and reduce muzzle pressure of the propellant gas and hydraulic shock wave when the projectile enters the water, can make use of many types of firearms for firing under the water. Smooth bore shotguns of 12 and 20 gauges, when used for firing under the water, can increase efficiency of underwater hunting against sea predators and decrease the number of their assaults on bathing people.

A device for underwater firing an automatic quick-firing gun is known, where a special blank round for displacing water from the chamber of the barrel before a live round is used (see Description to U.S. Pat. No. 5,639,982, Int. Cl.[6] F41F 3/07, published on 17, Jun. 1997).

However this device cannot be considered as a device for firing from within the dry barrel under the water because even at the fire rate of 600 rounds per minute the barrel chamber is filled with the water in the intervals between shots. Therefore, when the cartridge is extracted after the blank shot and the live round is loaded, the barrel will be filled with water, so the live shot will occur already in the water. When the weapon with the fire rate of 1000 rounds per minute is used, the water will partly fill the barrel before the live shot, which projectile will collide with a water blockage in the barrel.

A device for underwater firing from firearms is known, which comprises a dry weapon, a propellant charge, an underwater projectile with a sabot and a muzzle device with membranes (see Description to U.S. Pat. No. 7,237,353 B1, Int. Cl.[7] F41A 21/46, published on 3, Jul. 2007). The muzzle membrane seals the muzzle attachment opening intended for the passage of the projectile with the sabot through the assembly, while the side membrane seals the side-cut slots intended to bypass part of the propellant gases from the muzzle attachment into the water. An air supply system provides equalizing of the air pressure in the weapon with the exterior underwater pressure that prevents rupture of the membrane by the water pressure before the shot. During the shot the propellant gas bursts the side membrane of the muzzle attachment and partly flows out through the side-cut slots of the muzzle attachment into the water, while the projectile with the sabot penetrates the muzzle membrane and begins traveling in the water.

However this device needs replacing of membranes after each shot. Outflow of the propellant gas through the side-cut slots of the muzzle attachment enhances the effect of the hydraulic shock wave on the shooter and his weapon thus reducing the efficiency of fire. Besides, failure of the air supply system results in the rupture of the membranes in the weapon before the shot thus reducing general reliability of this device.

A device for underwater firing from firearms is known, which comprises a dry weapon, a propellant charge, an underwater projectile with a sabot and a muzzle attachment with a controllable muzzle valve having an opening intended for passage of the underwater projectile during the shot (see Description to U.S. Pat. No. 5,966,858, Int. Cl.[6] F41A 21/46, published on 19 Oct. 1999). The muzzle attachment has screens intended to detach the sabot from the projectile and to slow down the propellant gas. The muzzle attachment has an air supply system and a system for the propellant gas outflow, as well as a firing control mechanism, a muzzle valve control device and a device to control the muzzle valve opening before the moment of the propellant charge ignition. The air supply system provides equalizing of the air pressure in the weapon with the exterior underwater pressure before the shot.

In the course of the shot the screens of the muzzle attachment separate the sabot from the projectile and partly slow down the propellant gas that expands in the muzzle attachment and is partly bypassed into the system for the propellant gas outflow, but the main gas stream exits through the muzzle valve into the water, while the sabot fragments remain in the muzzle attachment.

However, for substantial reduction of the gas pressure and the hydraulic shock wave during when the projectile enters the water, the volume of the muzzle attachment is to exceed the volume of the barrel manifolds that is not provided in this device. Splitting of the sabot that hits the screens and the muzzle attachment housing results in vibration of the weapon. The propellant gas will push the fragments of the split sabots remained from previous shots, which will deflect the passing projectile from its trajectory thus reducing fire efficiency. Besides, requirement for the sabot discarding in the muzzle attachment is not valid, because, as the practice of underwater firing shows, the sabot is successfully discarded from the projectile in the water. The air supply system and the system for the propellant gas outflow, as well as the device to control the opening of the muzzle valve make this structure complicated and reduce general reliability of the device.

The most close analog (prototype) of the claimed invention is a device for underwater firing from firearms comprising a weapon with ammunition, means for fire control and a controllable muzzle valve, which is connected with the barrel and has a passage opening intended for the flight of the underwater projectile during the shot (see Description to U.S. Pat. No. 7,681,352 B2, Int. Cl.[7] F41C 9/06, published on 23 Mar. 2010). The muzzle valve in this device is opened by means of a piston that is moved in the barrel at the moment of the shot by the propellant gas discharged out of the barrel. In another embodiment of the device the muzzle valve is opened by means of an electric motor operated by the signal from a fire control device.

However, protection of the barrel bore against penetration of the water after opening of the muzzle valve is not provided in this device and collision of the projectile with a water blockage in the bore results in the barrel destruction. Opening of the muzzle valve by means of the piston or the electric motor at the moment of the projectile passing through the barrel reduces reliability of the device, because any failure to open the valve results in the barrel destruction. Installation of the muzzle valve inside the barrel does not provide reduction of the muzzle gas pressure. Higher gas pressure during the projectile entering the water enhances the hydraulic shock wave, which increases hydraulic pressure of the water in front of the muzzle end, the projectile does not form a cavitation cavity in this area and is slowed down by a viscous flow of water, and that reduces the projectile muzzle velocity as well as fire efficiency.

SUMMARY OF THE INVENTION

The purpose and the technical result of the given invention are to increase fire efficiency and reliability of the device for underwater firing from a firearm.

The purpose and mentioned technical result is provided by a device for underwater firing from a firearm comprising: a weapon with ammunition, a fire control tool and a controllable muzzle valve with a passage opening intended for passing of an projectile in the course of the shot, where, pursuant to this invention, the said device comprises an outer housing having at least a weapon and ammunition inside, and the fire control tool has at least one pyrotechnical charge, intended to produce excessive pressure inside the housing before firing, which exceeds the exterior water pressure, and the fire control tool is connected with the muzzle valve that provides firing after opening of the said valve in the result of increasing pressure of the pyrotechnical gas inside the housing and ceasing firing after closing of this muzzle valve, where the muzzle valve is installed in such a way that it can bypass the pyrotechnical gas from the housing into the water through its passage opening.

That stated totality of inventive features specified in the independent patent claim 1 allows increasing efficiency of firing under the water and reliability of the device for underwater firing of firearms according to the following differences from the prototype:

- the pyrotechnic charge produces excessive pressure inside the housing before firing and protects the barrel bore against water, while the gas flowing out into the water forms a gas bubble in front of the muzzle end thus improving conditions for the projectile entering the water and increasing efficiency of firing;
- expansion of the propellant gas in the housing with the volume that exceeds the volume of the barrel bore substantially reduces the propellant gas pressure and the hydraulic shock wave during entering of the projectile into the water, thus increasing efficiency of firing;
- effect of the fire control tool on the firing mechanism of the weapon by means of opening and closing the muzzle valve guarantees that the shot will be made only when the muzzle valve is open, thus increasing reliability of the device for underwater firing.

In the preferred embodiment of this invention the muzzle valve is made with possibility to close when the gas pressure in the housing decreases to the level of the exterior water pressure.

This embodiment provides the invention efficiency increase due to the guaranteed preventing water from entering the housing after the shot and reduction of the gas pressure in the housing to the level of the exterior water pressure.

In the embodiment of this invention there is a gap of 2 to 6 barrel bore calibers between the muzzle face of a weapon and the inner butt of the muzzle valve passage opening, diameter of this passage opening being 1.3-2.5 barrel bore calibers.

This embodiment allows one to increase the invention efficiency due to the fact that here the propellant gas can expand in the housing and discarding of the sabot from the projectile in the water after passing the muzzle valve is guaranteed.

The width of the clearance between the muzzle face and the inner butt of the muzzle valve passage opening depends on the power of the ammunition. When this gap is narrower than 2 barrel bore calibers, the hydraulic shock wave formed while the projectile enters the water grows up substantially, while the gap of more than 6 barrel bore calibers unreasonably increases the dimensions of the device.

The diameter of the muzzle valve passage opening depends on the width of the clearance between the muzzle face and the inner butt of the muzzle valve passage opening and takes into account angles of dispersion of the sabot fragments, which are discarded from the projectile and must not touch the walls of the muzzle valve passage opening.

In the embodiment of this invention the weapon is equipped with a muzzle attachment; moreover, there is a gap of 2 to 6 barrel bore calibers between the muzzle face of the said muzzle attachment and the inner butt of the muzzle valve passage opening, the diameter of this passage opening being 1.3-2.5 barrel bore calibers.

This embodiment allows one to increase the invention efficiency due to the application of muzzle attachments, which decrease the muzzle pressure of the propellant gas, as well as due to the fact that here the propellant gas can expand in the housing and discarding of the sabot from the projectile in the water after passing the muzzle valve is guaranteed.

In the embodiment of this invention the housing has a relief valve that provides bypassing of the pyrotechnic and/or propellant gas from the housing into the water when the pressure in the housing is higher than the exterior water pressure by specified value, e.g. more than twice as high.

This embodiment allows one to increase the invention efficiency due to the reduction of the pressure of the gas stream passing through the muzzle valve during intensive fire, because when the gas pressure in the housing becomes twice as high as the exterior water pressure, part of the propellant gas will exhaust through the relief valve.

In the embodiment of this invention the fire control tool comprises a mechanical drive to activate the firing mechanism of the weapon.

This embodiment allows one to apply this invention with the weapon having a mechanical firing mechanism, which can be controlled by the mechanical drive.

In the embodiment of this invention the fire control tool comprises an electromechanical drive to activate the firing mechanism of the weapon.

This embodiment allows one to apply this invention with the weapon having a mechanical firing mechanism, as well as with the weapon having an electromechanical firing mechanism intended to fire ammunitions with an electrical primer-igniter of the propellant charge.

In the embodiment of this invention the muzzle valve comprises an electromechanical and/or electro-hydraulic drive to provide opening and closing of the valve.

This embodiment allows one to increase the invention efficiency due to the decreasing of the dimensions of the muzzle valve and the muzzle part of the device for underwater firing, and therefore decreasing the drag force against moving this device in the water.

In the embodiment of this invention the housing is equipped with a laser and/or mechanical sight for aiming in a target.

This embodiment allows one to increase the invention efficiency due to the application of aiming devices for visual targeting of the weapon.

In one of particular embodiments of this invention the housing is installed in a mount that can move in horizontal and vertical plane.

This embodiment allows one to increase the invention efficiency due to the installation of the housing into the mount to make training in underwater firing easier. Installation of the housing in the mount on an underwater vehicle increases convenience of aiming and thus increases the fire efficiency.

In the embodiment of this invention the housing comprises at least two parts: inside one of them the weapon is installed, and ammunition are placed in the second part, which can be replaceable.

This embodiment allows one to increase the invention efficiency due to the reduction of the device dimensions and increase of its reliability when using a lot of ammunitions that can be placed in a magazine attached to the housing. In order to replace the magazine in this case there is no need to take the weapon out of the housing and then to reinstall it, as well as to re-verify the sighting-line by means of the aiming tool. Decreasing of dimensions of the device reduces the drag force against moving this device in the water.

BRIEF DESCRIPTION OF THE DRAWINGS

The invention is explained in more details on a specific example of its embodiment that by no means confines the scope of the invention, but is intended only for better understanding by an expert in the art.

In the description of the example of the particular invention embodiment there are references to the attached drawings, which depict the following.

DESCRIPTION OF THE PREFERRED EMBODIMENT

Figure 1:
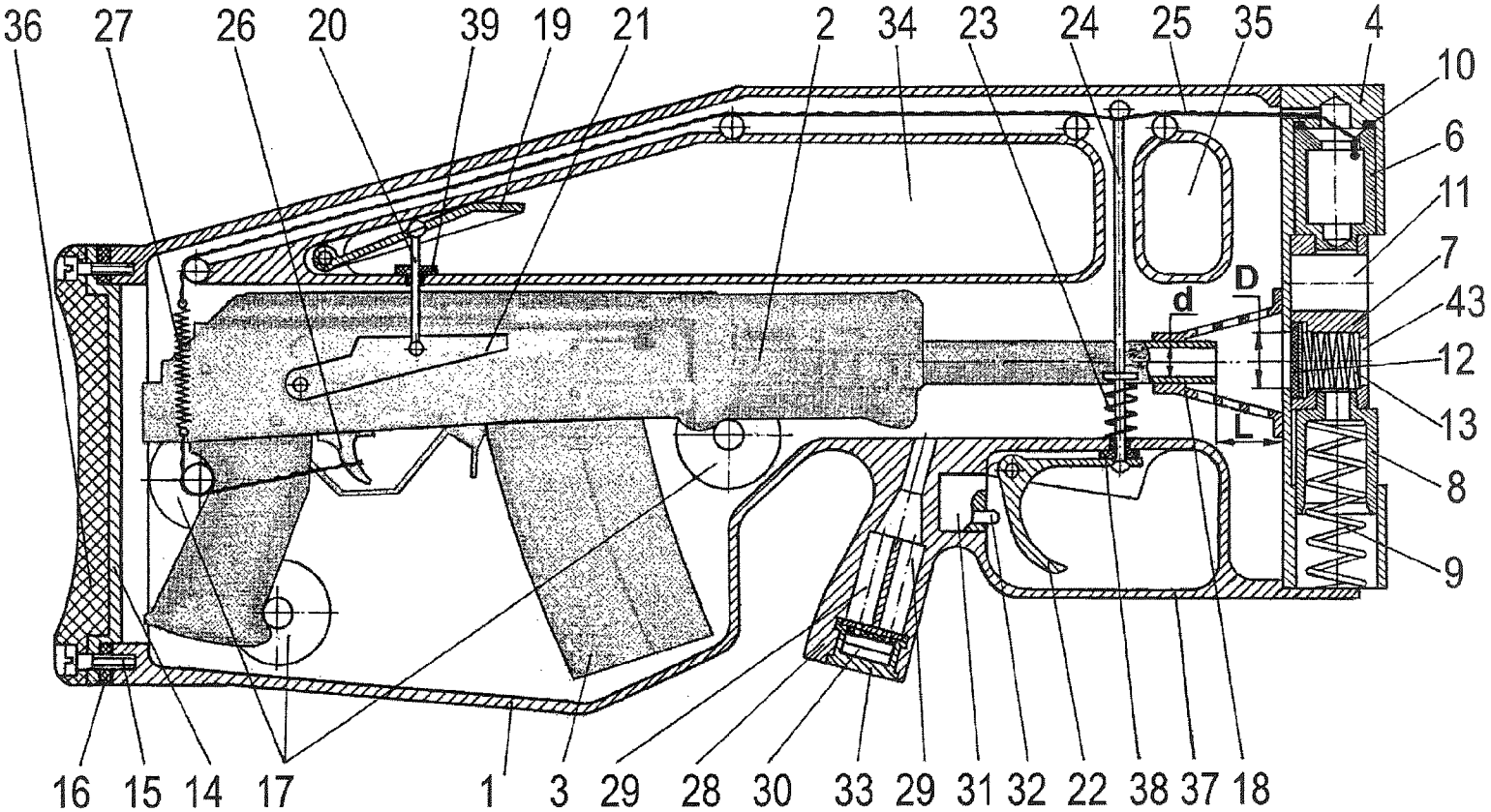
FIG. 1 shows example of the invention embodiment before the shot.

FIG. 1 shows the longitudinal cross-section of the proposed invention before the shot comprising a fire control mechanism with a mechanical drive and a 12-gauge sports/hunting gun "Saiga-12K" with a mechanical firing mechanism and detached butt-stock.

The device for underwater firing comprising: a housing 1 and firearm 2 with a magazine 3 for ammunition. The housing 1 is firmly attached to a muzzle valve assembly 4 that includes a piston 6, a slide 7, a piston 8 with a spring 9 and a sealing ring 10. The assembly 4 has a passage opening with diameter "D", the slide 7 has a passage opening 11, and these openings are mated before firing. The passage opening "D" of the assembly 4 is sealed by a disk 12 with a rubber gasket that is pressed by a spring 13. The rear end of the housing 1 is closed with a lid 14 by means of screws 15 and a rubber gasket 16. The firearms 2 is fixed in the housing 1 by means of fasteners 17 and a perforated barrel bushing 18 that provides alignment of the barrel bore axis having diameter "d" with the axis of the passage opening "D".

The fire control tool comprises a lever 19 with a shaft 20 and a switch 21 of a weapon firing mechanism safety-lock, as well as a trigger 22, a spring 23 and a pull-rod 24 connected with a cord 25 that connects the piston 6 with a trigger 26 of the weapon firing mechanism and has a spring damper 27. A handle 28 includes pyrotechnic charges 29 with an electric primer, an electric battery 30, an electronic module 31 with an activate button 32 and a lid 33, as well as electric contacts that provide ignition of the pyrotechnic charges 29 from the electric battery 30 at a signal from the electronic module 31.

To make holding of the device during firing more convenient the housing 1 has special windows 34 and 35, the lid 14 is equipped with a damping pad 38 and the trigger 22 is protected by a frame 37.

In this device the weapon barrel bore caliber (diameter) is d=18.3-18.5 mm, the barrel length is 430 mm, the barrel bore volume is 116 $cm^3$, the inner volume of the housing is about 5000 $cm^3$ that makes up approximately 40 volumes of the barrel bore. Proportions "L=2d" and "D=1.5 d" in this weapon provide that the gunpowder gas can expand inside the housing and the sabot can discard from the projectile in the water after passing the muzzle valve. The power of the pyrotechnic charge 29 is specified in accordance with the requirement that the excessive pressure of the pyrotechnic gases in the housing before the shot must exceed the exterior water pressure that depends on maximal expected depth of firing; e.g. for firing at the depth up to 30 m the gas pressure in the housing is to be at least 5 bar.

Preparation of the device for operation is carried out in the open air. The magazine 3 with ammunition is attached to the weapon 2 fixed in the housing 1, one round is seated into the cartridge chamber of the weapon 2 and by means of the switch 21 the firing mechanism of the weapon 2 is put into safe position. The pyrotechnic charges 29 are installed in the handle 28, but the number of pyrotechnic charges may be equal or less than the number of ammunition—see explanations below. The rear part of the housing 1 is sealed by the lid 14 with the gasket 16. The passage opening "D" of the muzzle valve is closed by the disk 12 with the rubber gasket pressed by the spring 13, while the piston 6 is pressed to the sealing ring 10 by means of the spring 9. In its lower part the housing 1 is sealed by the lid 33 and the rubber bushing 38, and in its upper part the housing 1 is sealed by the rubber bushing 39. The pressure inside the housing 1 is equal to the pressure of the outer air. When the device is submerged into the water, the exterior water pressure additionally compresses the sealing elements of the device thus providing reliable protection of the housing against the water penetration.

Figure 2:
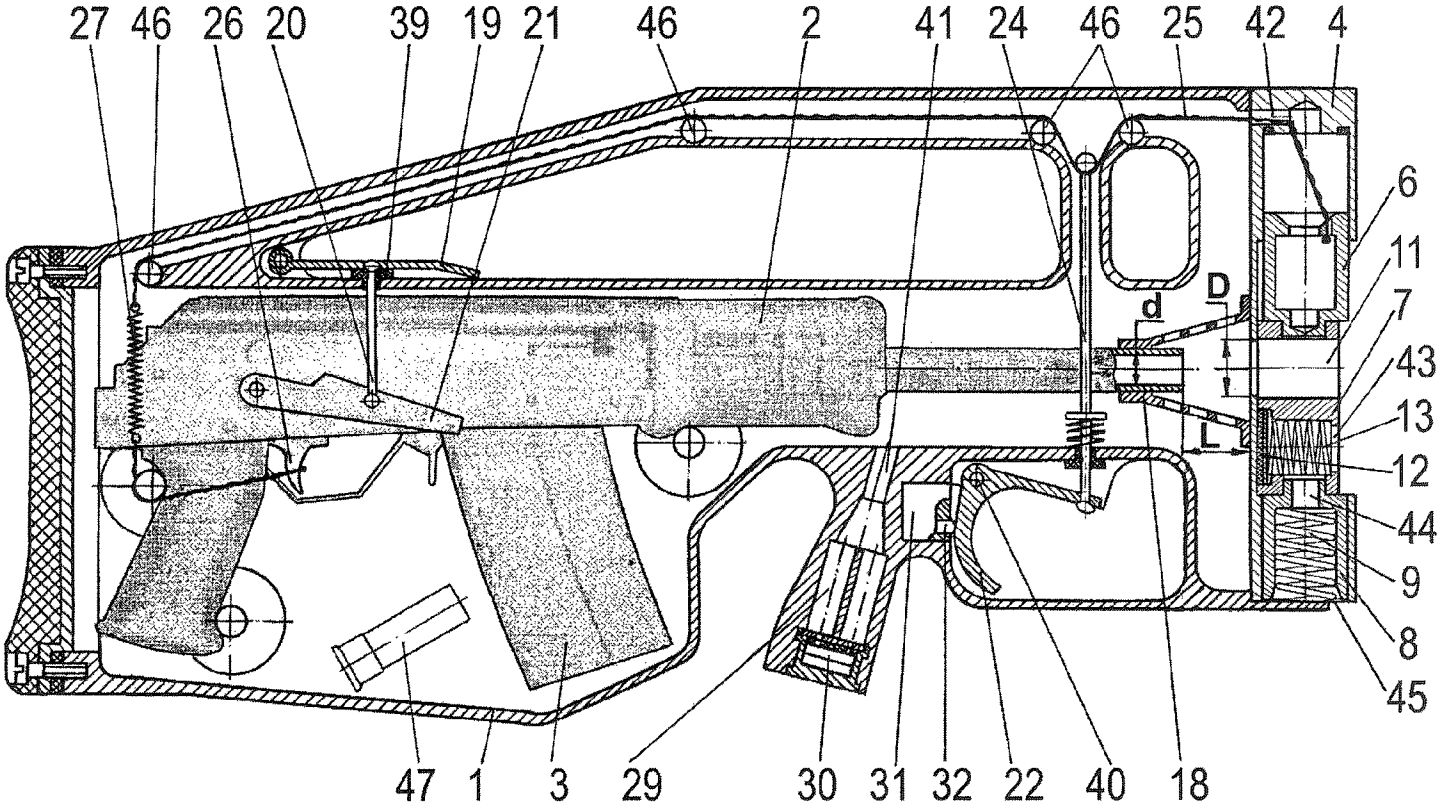
FIG. 2 shows example of the invention embodiment during the shot.

FIG. 2 shows the longitudinal cross-section of the proposed invention shown in FIG. 1 during the shot.

Before firing the shooter is to pull down the lever 19 that by means of the shaft 20 turns the switch 21 thus putting the weapon firing mechanism from the safe into the operating position.

In order to make a shot the shooter is to press the trigger 22 that will turn around an axle 40, push the pull-rod 24 down and provide pretension of the cord 25. The moving piston 6 affects the trigger 26 of the weapon firing mechanism only after the pretension of the cord 25.

The subsequent turning of the trigger 22 around the axle 40 presses the activate button 32, and the electronic module 31 generates a signal to ignite one pyrotechnic charge 29, the electric primer of which will be activated by the electric battery 30.

After ignition of the pyrotechnic charge 29 the pyrotechnic gas flows through an opening 41 into the cavity of the housing 1 and through an opening 42—into the cavity of the piston 6 producing in both cavities an excessive pressure that exceeds the pressure of the exterior water. Such pressure of the pyrotechnic gas results in the following:

- the disk 12 with a rubber gasket is pushed from the assembly 4 and compresses the spring 13;
- the piston 6 moves together with the slide 7 and the piston 8 that compresses the spring 9. The water from the cavity of the piston 8 flows out through openings 43, 44 and a window 45 and does not resist motion of the piston 8 till its end face thrusts against the inner surface of the housing 1;
- the passage opening 11 of the slide 7 is mated with the passage opening "D" of the assembly 4, thus providing that the passage opening of the muzzle valve is opened;
- the pyrotechnic gas flows through the passage opening "D+11" of the muzzle valve, as well as through the manufacturing clearances between the assembly 2, the piston 6 and the slide 7 and prevents water penetration into the housing;
- when the trigger 26 turns around and the firing mechanism of the weapon 2 is activated, the shot occurs and the projectile flows through the passage opening of the muzzle valve;
- during the shot some part of the gunpowder gas exhausts through the side apertures of the perforated barrel bushing 18 into the housing 1, while the other part of the gunpowder gas stream exhausts through the passage opening of the muzzle valve into the water;
- the mechanism of the weapon 2 extracts from the barrel a used cartridge 47 remaining inside the housing 1 and then seats the next ammunition from the magazine 3 into the barrel of the weapon 2.

The outflow of the pyrotechnic gas through the passage opening of the muzzle valve before the shot forms in the water a gas bubble that provides favorable conditions for the projectile to enter the water. Expansion of the gunpowder gas inside the housing 1 with the volume exceeding the volume of the barrel bore manifold substantially reduces the gas pressure and the hydraulic shock wave when the projectile enters the water.

After the shot the joint outflow of the gunpowder and pyrotechnic gases through the passage opening of the muzzle valve prevents water penetration into the housing. For some time (1-2 seconds), which depends on the depth of firing, the pressure in the housing is still excessive and the passage opening of the muzzle valve is open, so the next shot may be carried out.

To make the next shot the shooter has to release and then to press again the trigger 22, which through the pull-rod 24 and the cord 25 actuates the firing mechanism trigger 26 of the weapon 2. The trigger 26 should not press the button 32 of the electronic module 31, as that will result in the ignition of the next pyrotechnic charge 29; though such ignition is acceptable as it does not influence the firing, it results only in extra wasting of one pyrotechnic charge.

During the second shot the pressure in the housing 1 is still excessive for some time (1-2 seconds) due to the inflow of the gunpowder gases, so with the help of only one pyrotechnic charge it is possible to make the third shot, then the forth, the fifth till all the ammunitions are used. Such quick firing can be of use, for example, at the competitions in the "Agua shooting range" when the time of firing matters, but is not reasonable for underwater hunting.

When the firing is stopped, the gunpowder and pyrotechnic gases exhaust out of the housing 1 and into the water through the passage opening "D+11" of the muzzle valve, the spring 9 moves the piston 8, the slide 7 and the piston 6 into the initial position, and the passage opening of the muzzle valve will close. At the given depth of submergence the pressure in the housing 1 will exceed the exterior water pressure, because the spring 9 moves the piston 8 to the point where the inner pressure of the housing and the exterior water pressure are in balance, thus providing prevention against penetration of the water into the housing when the passage opening of the muzzle valve is closed.

For subsequent firing the shooter has to press the trigger 22, thus making the next shot, the process being described above.

When the firing is finished, the shooter is to pull down the lever 19 that by means of the shaft 20 turns the switch 21 thus putting the weapon firing mechanism into the safe position. All the mechanisms of the device return to their initial position depicted in FIG. 1.

If the device is submerged deeper, the exterior water pressure will exceed the inner pressure of the housing; that will additionally compress the sealing elements of the device thus providing reliable protection of the housing against the water penetration.

When the device comes to the surface (see FIG. 1), the excessive pressure of the gunpowder gases pushes the disk 12 with the rubber gasket from the assembly 4 and the gunpowder gases flow out from the housing 1 through the opening 43 and the manufacturing clearance between the assembly 2 and the slide 7. The pressure in the housing is still higher than the exterior water pressure, and the drop of pressure depends on the compressive force of the spring 13.

Disassembling of the device is carried out in the air. In order to detach the lid 14—e.g. to replace the magazine with the ammunition—the pressure inside the housing 1 and the outer air pressure are to be equalized. For this purpose it is necessary to slightly shift the piston 8 and compress the spring 9; the piston 6 will be released from the sealing ring 10 and the excessive gas will exhaust out of the housing through the manufacturing clearance between the assembly 2 and the piston 6.

The device depicted in FIG. 1 and FIG. 2 is equipped with a mechanical and laser sight (not shown in the drawings) and can be used for underwater hunting and target sports shooting. The housing is made of aluminum alloy and can withstand pressure drop up to six-fold. The mass of the housing is 4 kg, its submerged displacement is 6.5 kg, the mass of the gun "Saiga-12K" with 6 ammunition and detached butt-stock is 3.5 kg, the weight of the device in the water is about 1 kg. It is anyway more convenient than to use the gun "Saiga-12K" for underwater firing, because its mass with 6 ammunition and the butt-stock is 3.8 kg, the weight of the gun in the water is 3.2 kg, while the muzzle velocity of the underwater projectile is 2.5 times lower than in the proposed device.

The device with the design shown in FIG. 1 and FIG. 2 can be applied for underwater firing, as well as for firing from the water and into the air, for firing in the air and from the air and into the water using many types of firearms. However, it is important to take into account design features and geometry of the applied weapon, as well as conditions of its application.

It also should be taken into consideration that when the quick-firing weapon is used, the gunpowder gas will accumulate in the housing, so it is preferable to equip the device with a relief valve that will bypass the gas from the housing into the water when the pressure in the housing is two or three times higher than the exterior water pressure. That allows one to reduce the mass of the housing, the strength of which has to securely withstand the required gas and water pressure drop. That does not mean that the maximal depth of firing is limited by the strength of the housing, because during submerging it is possible to use the pyrotechnic charges 29 that will equalize the gas pressure in the housing and the exterior water pressure. The excessive pyrotechnic gas will release the disk 12 with the rubber gasket from the assembly 4 and exhaust from the housing into the water through the opening 43. In the case when the pyrotechnic charge 29 is ignited, the piston 6 shifts and the passage opening of the muzzle valve is opened, no shot will occur, because the weapon is at the safety position and the tension of the cord 25 will be compensated by the spring damper 27 thus preventing breakage of the cord 25.

For the weapon with an electromechanical firing mechanism, for firing ammunition-with an electric primer, as well as for remote firing the electromechanical mechanism of fire control must be used that actuates the firing mechanism of the weapon by means of the electromechanical drive. In order to actuate the electric firing mechanism of the weapon the cord 25 may be used. However it is more convenient to install sensors for opening/closing of the passage opening of the muzzle valve and actuate the electric firing mechanism of the weapon by means of an electric signal. For opening/closing of the muzzle valve the electromechanical and electrohydraulic drives may be used. The design of these mechanisms is well known in the art and needs no explanations.

When it is required to use a lot of ammunition, the reasonable solution is to divide the housing into two parts: inside one of them the weapon is installed, and ammunition are placed in the second part, which can be replaceable and attachable to the first part leak-proof. In order to replace the magazine with ammunition in this case there is no need to take the weapon out of the housing and then to reinstall it, as well as to re-verify the sighting-line by means of the aiming tool. Depending on the type of the weapon there may be several such magazines and therefore several component parts. These component parts of the housing can have common internal space where the pyrotechnic and the propellant gases are expanded.

For high-power ammunitions it is reasonable to use muzzle attachments that allow firing caliber and sub-caliber underwater projectiles (bullets) with discarding sabots (see Description to Patent RU 2355967 C1, Int. CI.[7] F41A 21/32 of 20, May 2009; the U.S. Pat. No. 8,464,625 B2, Int. CI.[7] F41A 21/34 of 18 June 2013; European Patent Application 08857912.3 of 15 Oct. 2008, publication No. EP 2 224 200 A1 of 1 Sep. 2010). That allows one to substantially reduce the gas pressure and the hydraulic shock wave when the projectile enters the water.

Industrial Applicability

The invention can be applied for underwater firing, as well as for firing from the water and into the air, for firing in the air and from the air and into the water using many types of artillery weapons and small arms, already available and prospective. But it is important to take into account the design features and geometry of the applied weapon, as well as conditions of its application.

The invention claimed is:

1. A device for underwater firing from a firearm comprising: a weapon with ammunition, a fire control tool and a controllable muzzle valve with a passage opening intended for passing of a projectile in the course of the shot, wherein the said device comprises an outer housing having a weapon with ammunition inside, and the fire control tool has at least one pyrotechnical charge, intended to produce excessive pressure inside the housing before firing, which exceeds the exterior water pressure, and the fire control tool is connected with the muzzle valve that provides firing after opening of the said valve in the result of increasing pressure of the pyrotechnical gas inside the housing and ceasing firing after closing of the muzzle valve, where the muzzle valve is installed in such a way that it can pass the pyrotechnical gas from the housing into the water through its passage opening.

2. The device of claim 1, wherein the muzzle valve is made with possibility to close when the gas pressure in the housing decreases to the level of the exterior water pressure.

3. The device of claim 1, wherein there is a gap of 2 to 6 barrel bore calibers between the muzzle face of a weapon and the inner butt of the muzzle valve passage opening, the diameter of this passage opening being 1.3-2.5 barrel bore calibers.

4. The device of claim 1, wherein the weapon is equipped with a muzzle attachment, moreover, there is a gap of 2 to 6 barrel bore calibers between the muzzle face of the said muzzle attachment and the inner butt of the muzzle valve passage opening, the diameter of this passage opening being 1.3-2.5 barrel bore calibers.

5. The device of claim 1, wherein the housing has a relief valve that provides bypassing of the pyrotechnic and/or propellant gas from the housing into the water when the pressure in the housing is higher than the exterior water pressure by specified value.

6. The device of claim 1, wherein the fire control tool comprises a mechanical drive to actuate the firing mechanism of the weapon.

7. The device of claim 1, wherein the fire control tool comprises an electromechanical drive to actuate the firing mechanism of the weapon.

8. The device of claim 1, wherein the muzzle valve comprises an electromechanical and/or electro-hydraulic drive to provide opening and closing of the muzzle valve.

9. The device of claim 1, wherein the housing is equipped with a laser and/or mechanical sight for aiming in a target.

10. The device of claim 1, wherein the housing is installed on a mount that can move in horizontal and vertical plane.

11. The device of claim 1, wherein the housing comprises at least two parts: the weapon is installed inside the first part and ammunition are placed in the second part, which can be replaceable.

* * * * *